US005533654A

United States Patent [19]

Holty et al.

[11] Patent Number: 5,533,654

[45] Date of Patent: Jul. 9, 1996

[54] SUPPORT APPARATUS

[76] Inventors: Anton G. Holty, 3850 Klahanie Dr. SE #19-102, Issaquah, Wash. 98027; Frederick J. Wilson; Edward D. Sozinho, both of P.O. Box 27047, Fresno, Calif. 93729-7047

[21] Appl. No.: 184,834

[22] Filed: Jan. 21, 1994

[51] Int. Cl.[6] ..... A45F 4/02

[52] U.S. Cl. ..... 224/155; 224/634; 224/635; 297/4; 297/59

[58] Field of Search ..... 224/153–156, 224/209, 210, 213; 297/4, 17, 25, 46, 48, 59, 60, 129

[56] References Cited

U.S. PATENT DOCUMENTS

| | | | |
|---|---|---|---|
| D. 338,779 | 8/1993 | Albert . | |
| 1,302,927 | 5/1919 | Jancyzk . | |
| 2,922,465 | 1/1960 | Johansson . | |
| 3,292,830 | 12/1966 | Mack . | |
| 3,315,856 | 4/1967 | Black . | |
| 4,058,341 | 11/1977 | Prws | 297/48 X |
| 4,362,307 | 12/1982 | Nakatani | 224/153 |
| 4,392,598 | 7/1983 | Dixon . | |
| 4,450,990 | 5/1984 | Bolstad . | |
| 4,487,345 | 12/1984 | Pierce et al. | 124/155 |
| 4,530,451 | 7/1985 | Hamilton | 224/155 |
| 4,676,548 | 6/1987 | Bradbury | 297/129 |
| 4,720,029 | 1/1988 | Varanakis | 224/155 |
| 4,773,574 | 9/1988 | Burgard | 224/155 |
| 4,795,068 | 1/1989 | Blean | 224/155 |
| 4,972,981 | 11/1990 | Gex . | |
| 5,209,381 | 5/1993 | Jay . | |
| 5,244,250 | 9/1993 | Nordmeyer | 297/59 |
| 5,303,975 | 4/1994 | Asato | 297/129 |

FOREIGN PATENT DOCUMENTS

| | | |
|---|---|---|
| 782215 | 9/1957 | United Kingdom . |
| 1194851 | 6/1970 | United Kingdom . |

*Primary Examiner*—J. Casimer Jacyna
*Attorney, Agent, or Firm*—Worrel & Worrel

[57] ABSTRACT

A support apparatus having a support member; and an assembly for mounting the support member on a first work object for movement between a first attitude, in which the support member is disposed in a stored condition, and a second attitude, in which the support member is disposed in a condition for use in supporting a second work object.

5 Claims, 3 Drawing Sheets

SUPPORT APPARATUS

BACKGROUND OF THE INVENTION

1. Field of the Invention:

The present invention relates to a support apparatus and, more particularly, to such a support apparatus which is operable to support a work object, such as a backpack, while affording a secondary surface of support when desired.

2. Description of the Prior Art

There are a variety of environments in which limitations as to weight, space and the like effectively preclude the use of conveniences which otherwise would be desirable. For example, in such outdoor activities as backpacking, hiking, mountain climbing and camping, severe limitations exist with regard to the ability to carry provisions. Since those provisions necessary to support life, such as food, clothing, a sleeping bag, cooking utensils and the like, normally exhaust the available weight and space limitations, the conveniences of life must be left behind.

More specifically, in such recreational activity a person can carry only those items necessary for survival. These necessarily include those provisions previously noted, containerized in such a fashion as to minimize weight and space, as well as such other materials which may inherently be compact and of light weight. Such items as medical supplies, a flashlight and those items intrinsic to the particular activity, such as a rope, pitons, or the like, may fall into this category. The cumulative weight of such necessities conventionally precludes any consideration of transporting other items. There is certainly no conventional capability, as a practical matter, for carrying conveniences such as chairs or other surfaces of support. These limitations are even more acute when the person to carry such provisions is a child, or an adult with impaired physical abilities, and yet they may be in particular need in these instances for such conveniences.

The lack of such conveniences becomes particularly burdensome upon venturing into remote areas because of the lack of naturally occurring, physical phenomena to be utilized as substitutes for these unavailable conveniences. Accordingly, it has long been recognized that it would be desirable to be able to carry a support under such conditions which was lightweight, compact, readily deployed and comfortable in use for such purposes.

Recognition of this long felt need is evidenced in prior art efforts to provide such a support. The prior art is replete with devices intended to be collapsed for ready transport and then to be folded out when desired to serve as a chair or other supporting surface. All such prior art devices have suffered from numerous deficiencies which, for all practical purposes, render them entirely inadequate for their intended purposes. Such prior art efforts have assumed several characteristic forms. One type is embodied in a backpack having a wooden frame adapted to be folded out into the configuration of a chair. Characteristically, this type of prior art device requires a considerable amount of assembly and, in most cases, necessitates that individual parts, not attached to the backpack, be carried in the backpack for use in such assembly. The weight and space limitations previously discussed render such devices entirely impractical. In addition, the thickness and weight of the wood causes the backpack to absorb moisture and therefore to become even more heavy and cumbersome.

Other characteristic types of prior art devices include collapsible chairs designed solely for use as chairs and which are incapable of supporting a backpack. When the weight of a backpack is attached to the chair, it is overturned, unless, of course, someone is seated in the chair, or the chair is otherwise weighted down. Some such prior art devices can support a small container, such as that suitable for holding small items as for use at the beach. This type of prior art device is completely inadequate for such activities as backpacking, hiking, mountain climbing, camping and the like.

Still further, there are prior art devices known as "packstands" adapted solely to support backpacks in upstanding relation at a rest stop or campsite. The object of such devices is to make the various compartments of the backpack more readily accessible while avoiding the wear, uncleanliness and accessibility to pests associated with simply being laid on the ground. They do not afford a support surface and are notoriously prone to fall over due to the weight of the backpack.

Therefore, it has long been known that it would be desirable to have a support apparatus which is adapted to support a work object while being operable to afford a secondary surface of support when desired; which is uniquely well suited to the support of a backpack in an upright fashion; which is operable to provide a surface of support for the weight of a human being or the like while supporting a backpack in an upright attitude whether or not the surface of support is occupied; which can conveniently be retracted to a position suitable for transport; which is lightweight and easy to carry for any length of time; and which is otherwise entirely successful in achieving its operational objectives.

SUMMARY OF THE INVENTION

Therefore, it is an object of the present invention to provide an improved support apparatus.

Another object is to provide such a support apparatus having particular utility in the support of a backpack in an upright fashion so as to operate as a packstand.

Another object is to provide such a support apparatus which has particular utility in operation in conjunction with a backpack while affording a secondary surface of support which can be deployed when desired for the support of a human being, or any other work object, while supporting the backpack in an upright attitude, whether or not the secondary surface of support is occupied.

Another object is to provide such a support apparatus having a secondary surface of support adapted readily to be retracted for use of the backpack and without in any way interfering with, or detracting from, use of the backpack.

Another object is to provide such a support apparatus which is lightweight and capable of being carded by a human being for extended periods of time irrespective, relatively, of the size or strength of the human being, thus being entirely suited to usage by children and adults of impaired physical capabilities.

Another object is to provide such a support apparatus which can readily be assembled and deployed without the use of additional parts and without the use of tools.

Another object is to provide such a support apparatus which can be retrofitted on existing backpacks, or the like, or which, alternatively, can be manufactured as integral parts of backpacks at the time of manufacture thereof.

Another object is to provide such a support apparatus which is automatically adjustable upon the application of weight thereto to support human beings of virtually any size and weight and which is otherwise adjustable to suit the comfort of the individual involved.

Another object is to provide such a support apparatus which interoperates with a backpack, or the like, in such a fashion as not in any way to detract from normal usage of the backpack, but which, when desired, is readily available and operable for use in supporting the backpack or the like in an upstanding attitude while affording a secondary surface of support available for usage when and as desired.

Further objects and advantages are to provide improved elements and arrangements thereof in an apparatus for the purpose described which is dependable, economical, durable and fully effective in accomplishing its intended purpose.

These and other objects and advantages are achieved, in the preferred embodiment of the support apparatus of the present invention, in an apparatus having a frame adapted to be mounted on a backpack and having support surfaces operable to support the backpack in an upright attitude; and a secondary surface of support mounted on the frame and adapted to be deployed to receive a work object in rested relation thereon.

DESCRIPTION OF THE PREFERRED EMBODIMENT

Figure 1:
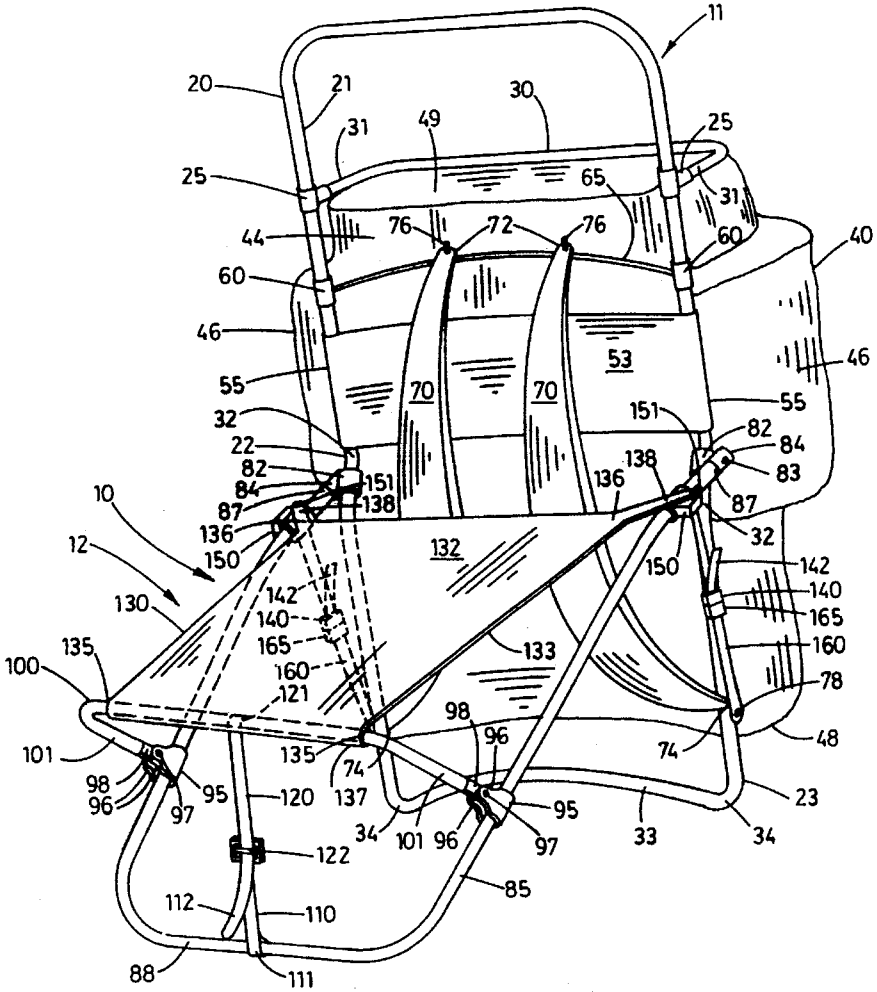
FIG. 1 is a perspective view of the support apparatus of the present invention shown in a typical operative environment mounted on a backpack and with the secondary surface of support thereof deployed in an extended attitude for use.

Referring more particularly to the drawings, the support apparatus of the present invention is generally indicated by the numeral 10 in FIG. 1.

Figure 3:
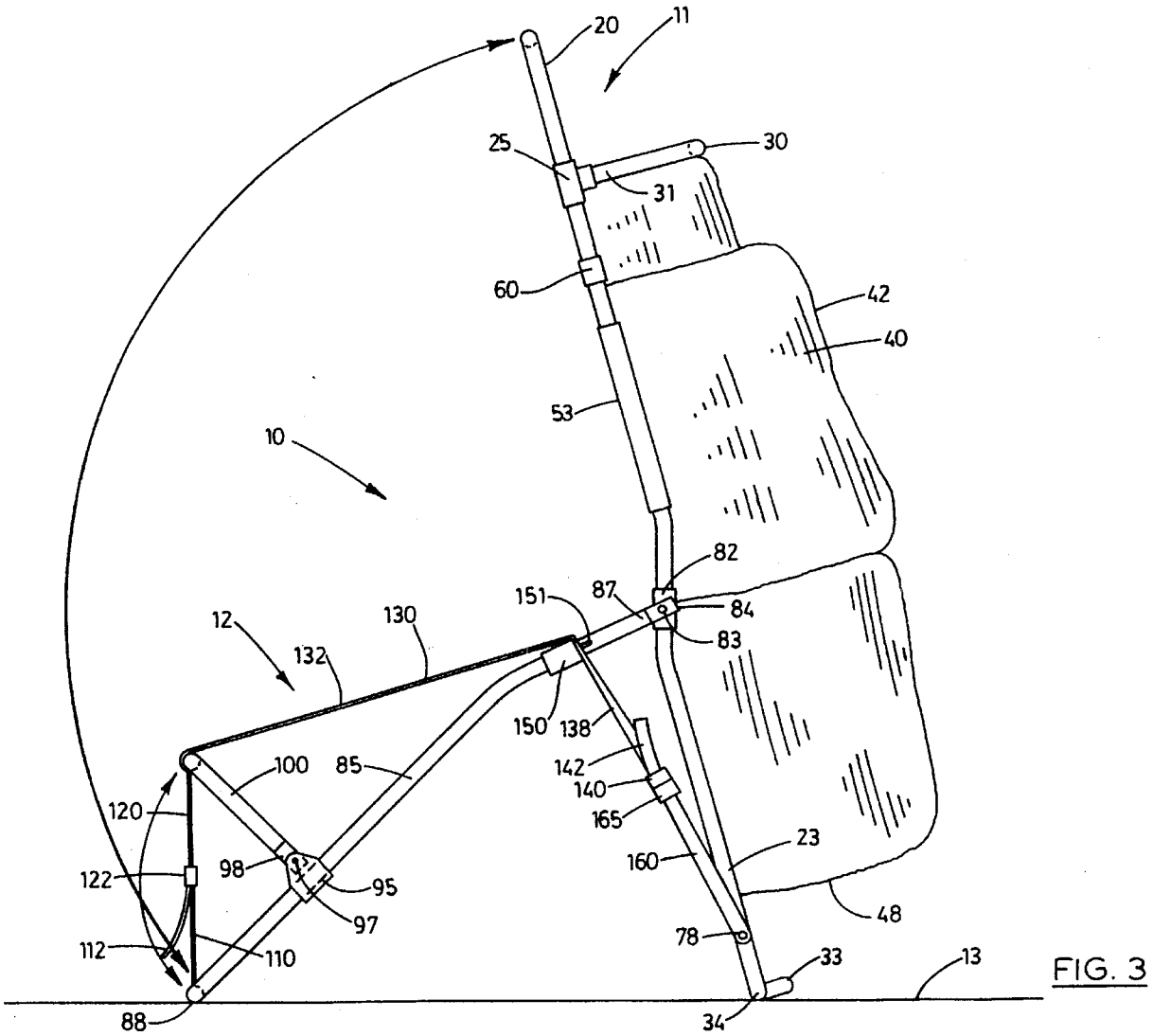
FIG. 3 is a somewhat enlarged side elevation of the support apparatus showing the secondary surface of support deployed in an extended attitude and depicting the directions of movement of the subcomponents thereof to and from the extended attitude.
Figure 5:
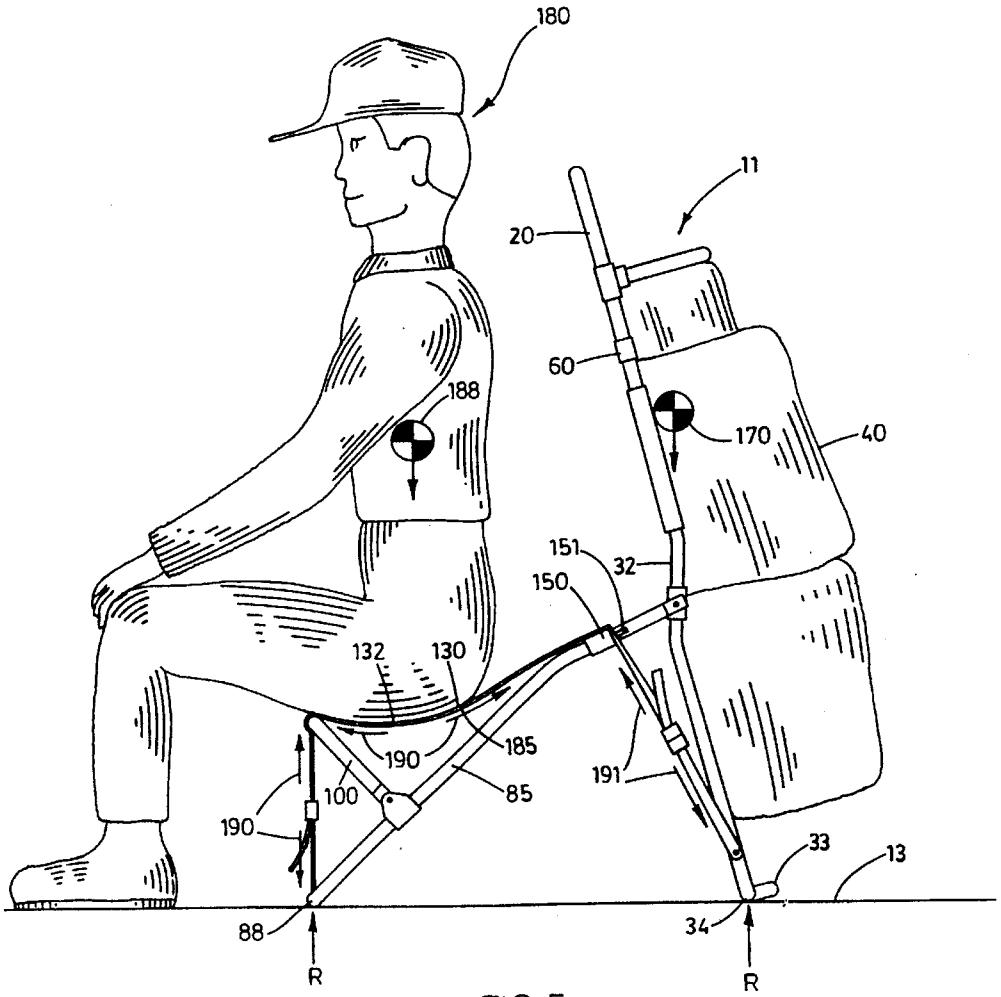
FIG. 5 is a side elevation of the support apparatus illustrating the relative positions of the center of gravity of the support apparatus and the center of gravity of a person seated on the secondary surface of support in reference to the reaction forces.
Figure 4:
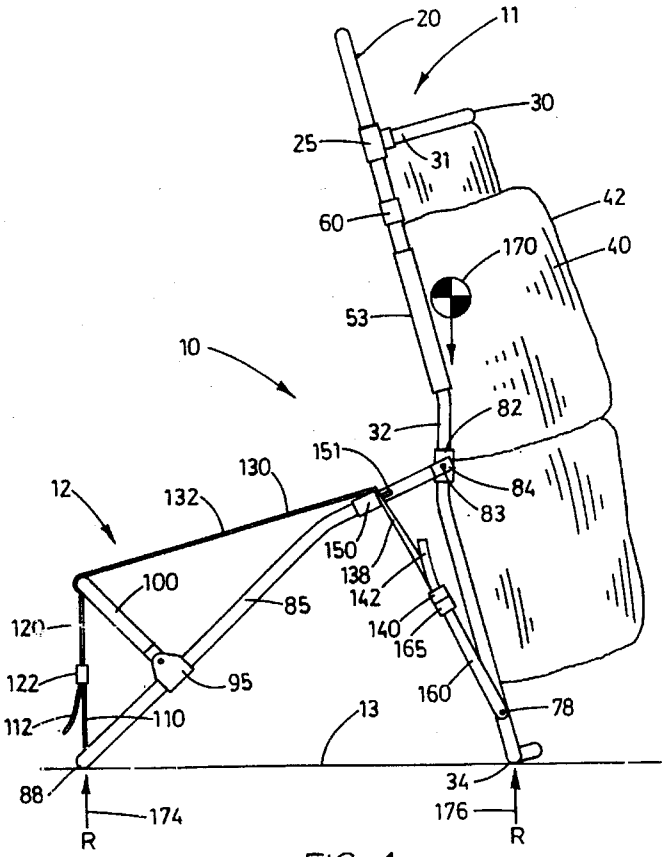
FIG. 4 is a side elevation of the support apparatus illustrating the center of gravity thereof and the relative positions of the reaction forces resulting therefrom.

As shown in FIG. 1 and throughout the other views, the support apparatus 10 is employed in a representative operative environment interoperating in combination with a backpack 11. As will become more clearly apparent, the support apparatus of the present invention can be employed in a variety of environments and embodiments to perform its various operational objectives. However, the support apparatus is particularly well suited to usage in combination with a backpack. The support apparatus of the preferred embodiment thus can be viewed generally as having a backpack 11 and a secondary support assembly generally indicated at 12. The support apparatus, in the illustrative embodiment, can be manufactured as an integral part of the backpack at the time of manufacture of the backpack. Alternatively, the support apparatus can be, manufactured so that the secondary support assembly 12 thereof is manufactured separately and adapted to be retrofitted on any existing backpack by the purchaser. As shown in FIGS. 3, 4 and 5 for illustrative convenience, the earth's surface, or other surface of support, is generally indicated by the numeral 13.

The backpack 11 has a primary frame 20 constructed of tubular metal, such as aluminum, or any other suitable material. The primary frame 20 has a U-shaped top portion 21, a middle portion 22 and a bottom portion 23. Mounted on the top portion 21 of frame 20 at parallel positions are T-couplings 25. The T-couplings are preferably constructed of plastic, lightweight metal, or another suitable material. A U-shaped frame 30, having parallel end portions 31, is mounted on the T-couplings with the end portions 31 inserted in the T-couplings 25. The end portions are secured in the T-couplings by rivets or the like. The U-shaped frame 30 extends outwardly in right-angular relation to the frame 20 and is also preferably constructed of tubular metal, such as aluminum, or the like. The primary frame 20 thus generally describes a rectangular configuration, but has laterally parallel offset portions 32 in the middle portion 22 thereof and an arcuate lower extremity 33 in the bottom portion 23 thereof bounded by opposite lower rest surfaces 34.

The backpack 11 need only generally be described since it can be of any suitable construction. The backpack has a bag 40 preferably constructed of cloth, synthetic material, or the like. The bag has a front wall 42, a back wall 44 and opposite side walls 46. The bag 40 has a bottom wall 48 and a top wall 49. The bag has a tubular upper structure 51, preferably constructed of the same material as the remainder of the bag, mounted on the top wall 49. The tubular upper structure is secured on the U-shaped frame 30 by any suitable means so as to extend between the top wall 49 and the U-shaped frame.

A fabric panel or strap 53, having opposite ends 55, is mounted on and extends across the middle portion 22 of the frame 20. The opposite ends 55 extend in covering relation to the middle portion of the frame 20 and are stitched on the bag 40 at the intersection of the back wall 44 and each of the side walls 46.

Figure 2:
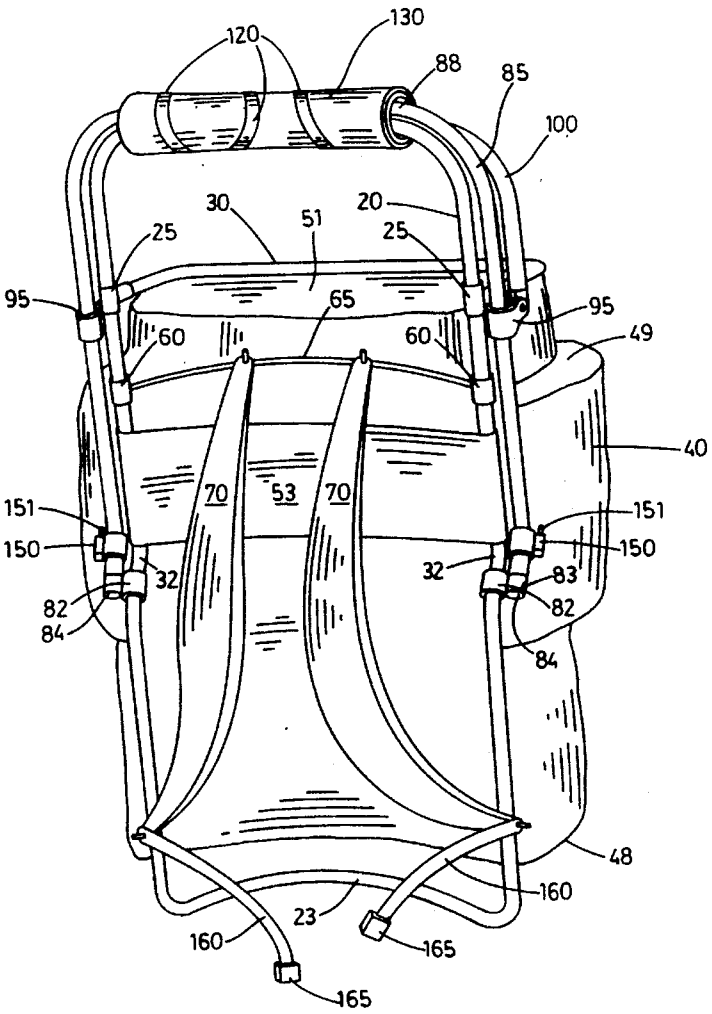
FIG. 2 is a perspective view of the support apparatus of FIG. 1 shown with the secondary surface of support thereof deployed in a retracted, or collapsed, attitude.

Couplings 60 are mounted on the frame 20 on opposite sides of the upper portion 21 thereof a predetermined distance below the T-couplings 25. A support bar or rod 65, preferably constructed of metal or the like, is mounted on and interconnects the couplings 60 extending therebetween. The rod describes an arc substantially corresponding to that of the arcuate lower extremity 33 and as best shown in FIGS. 1 and 2. Two shoulder straps 70, having top end portions 72 and bottom end portions 74, are mounted at their respective top end portions 72 on the support rod 65 by upper pins 76 borne by the support rod. The top end portions of the shoulder straps are mounted in predetermined spaced relation to each other, as best shown in FIGS. 1 and 2. The bottom end portions 74 of the shoulder straps 70 are mounted on opposite sides of the bottom portion 23 of frame 20 by lower pins 78. The shoulder straps 70 extend between their respective upper and lower pins in the arrangement shown in FIGS. 1 and 2 so as to be available for the user to slip his or her shoulders between each respective shoulder strap and the frame 20 so as to support the frame and backpack 11 on the back of the user. In this arrangement, the top end portions of the shoulder straps extend over and are individually supported on the user's shoulders in the conventional manner.

The secondary support assembly 12 has sleeves 82 which are individually mounted in fixed positions on the offset portions 32 of the middle portion 22 of frame 20 in the locations best shown in FIG. 2. A pivot pin 83 is mounted on each of the sleeves 82 and extends laterally outwardly from the frame 20 in right angular relation to its respective offset portion 32 of the frame. The pivot pins 83 thus, together, define an axis within a plane of reference defined by both offset portions of the frame 20, as can be visualized by reference to FIG. 3. A coupling 84 is mounted on each of the pivot pins 83 for pivotal movement thereabout. A U-shaped secondary frame 85, having parallel end portions 87, is mounted on the couplings 84. The secondary frame is preferably constructed of a lightweight metal tube. The end portions 87 of the secondary frame are individually received in and affixed to the couplings 84. The secondary frame is thereby mounted on the primary frame 20 for pivotal movement about the axis defined by the pivot pins 83. The secondary frame has a distal edge or support surface 88 parallel to the axis defined by the pivot pins 83.

U-shaped brackets 95 are individually mounted on the secondary frame 85 aligned transversely of the secondary frame in parallel positions, as shown best in FIG. 1. Each of the brackets is fitted in conforming relation to its respective tubular member of the secondary frame and has flanges 96 on which a pivot pin 97 is mounted so as to extend therebetween. The pivot pins 97 of the respective brackets 95 are aligned transversely of the secondary frame 85 to define an axis parallel to the support surface 88 and the axis defined by the pivot pins 83. A coupling 98 is mounted for pivotal movement on the pivot pin 97 of each of the brackets 95.

A U-shaped tertiary frame 100, having parallel end portions 101, is mounted on the couplings 98 with the end portions thereof individually received in and mounted on the couplings and affixed thereon by any suitable means. Thus, the tertiary frame is mounted for pivotal movement one hundred and eighty degrees (180°) about the axis defined by the pivot pins 97 and, within that range, between the positions shown in FIGS. 1 and 2.

A first strap 110, having a loop 111 at one end thereof, is attached to the secondary frame 85 with the loop 111 extending slidably about the frame member thereof and is centered thereon. The first strap 100 extends to a distal end portion 112. A second strap 120, having a loop 121 at one end thereof, is slidably received on the frame member of the tertiary frame 100 and is centered thereon. A connector 122, of any suitable type adapted to receive a strap therethrough and for adjustment to any position thereon and then releasably to be locked in the selected position, is mounted on the distal end portion of the second strap 120. The distal end portion 112 of the first strap 110 is slidably extended through the connector 122 of the second strap. By pulling downwardly on the distal end portion 112 of the first strap 110 with the support apparatus deployed in the attitude shown in FIG. 1, force is applied to draw the tertiary frame downwardly toward the support surface 88 of the secondary frame 85.

The support apparatus 10 has a support or seat panel 130 preferably constructed of a heavy cloth, or woven synthetic material. The seat panel 130 has an upper surface 132 and an opposite lower surface 133. The seat panel has two proximal corners 135 and two distal corners 136, as best shown in FIG. 1. The seat panel 130, between the two proximal corner's 135, forms a loop 137, as best shown in FIG. 1, slidably received about the frame member of the tertiary frame 100 between the proximal corners. A strap 138 is mounted on and extends from each of the distal corners. A connector 140 is slidably received on each of the straps 138 so that an end portion 142 extends therefrom, as shown in FIG. 1. A hole, bounded by a reinforcing ring, not shown, extends through each of the straps 138 in a predetermined position between its respective distal corner 136 and the connector 140. If desired, a plurality of such holes, bounded by reinforcing tings, can be provided in each strap to afford a corresponding plurality of adjusted attitudes, as will hereinafter be discussed in greater detail.

Brackets or supports 150 are individually mounted on the secondary frame 85 adjacent to the end portions 87 thereof. The brackets extend laterally of the secondary frame 85 aligned transversely thereof along an axis parallel with the axis defined by the pivot pins 83. Each of the brackets mounts a pin 151 extending toward the pivot pin 83 on its respective side of the secondary frame. The hole, not shown, in each strap 138 and the respective pin of the bracket are positioned relative to each other so that the pin can be extended through the hole of its respective strap 138 to retain the seat panel in the position shown in FIG. 1. The securing of seat panel 130 by straps 138 will hereinafter be discussed in greater detail.

A pair of straps 160, individually mounting connectors 165 at common ends thereof, are themselves individually mounted, at the opposite ends on opposite sides of the bottom portion 23 of the primary frame 20, on their respective lower pins 78. The straps 160 are mounted in alignment with the bottom ends 74 of straps 70. The connectors 165 are individually interlocked with their respective connectors 140, as shown in FIG. 1. The connectors 140 and 165 of each interconnected pair are preferably, although not necessarily, of the snap-fit type which can be pressed together immediately to interlock and which have portions which can be compressed immediately to disconnect the connectors from each other. Thus, once interlocked, by pulling on the end portions 142 of the straps 138, the interconnection of the straps 160 and straps 138 can be tightened, or alternatively loosened, thereby pivoting the primary frame 20 to the desired angle relative to the surface of support 13, as can best be visualized in FIG. 3. In other words, tension is thereby adjusted in the interconnected straps 160 and 138 between the respective pins 151 and lower pins 78.

As shown in FIG. 4, the support apparatus 10 is disposed in an upright, fully extended and operable attitude. For illustrative convenience, the center of gravity of the support apparatus in this operable attitude is indicated by numeral 170. This center of gravity remains between the surfaces of support 34 and 88 whether the backpack is fully loaded or not. A first reaction force in response to this center of gravity is indicated by numeral 174 applied to the support surface 88 where the secondary frame 85 rests upon the surface of support 13. Second reaction forces are indicated by the numeral 176 applied to the lower rest surfaces 34 of the primary frame 20 by the surface of support 13.

As shown in FIG. 5 for illustrative convenience, a human being or person 180 is shown in a seated position with posterior 185 in engagement with the top surface 132 of seat panel 130. The center of gravity of the person in this seated position is indicated by the numeral 188. The weight of the person 180 upon the seat panel 130 applies various tensions and reaction forces to the seat panel 130 and related structures of the support apparatus. The weight of the person causes tightening of interconnected strap 110 and strap 120 and the seat panel 130. These tensions, or reaction forces, are indicated by the arrows 190 in FIG. 5. The tensions, or reaction forces, in the interconnected straps 160 and 138 between the respective pins 151 and lower pins 78 are indicated by the arrows 191 in FIG. 5.

OPERATION

The operation of the described embodiment of the present invention is believed to be readily apparent and is briefly summarized at this point.

As illustrated in FIG. 2, the support apparatus 10 is disposed in a fully retracted, or collapsed, configuration. In this configuration, the backpack 11 is employed in the otherwise conventional manner supported on the back of a person. As previously noted, this is achieved by the person inserting his or her arms individually through the shoulder straps 70. The shoulder straps are then rested upon the shoulders to support the support apparatus on the back of the user. The support apparatus can be carried in this manner for a period of time not in any way reduced by the weight of the secondary support assembly 12. This is because the support apparatus is only very slightly heavier than a conventional backpack.

Furthermore, as shown in FIG. 2, the secondary support assembly 12, in the fully retracted, or collapsed, configuration extends about, or in other words is outwardly laterally disposed relative to, the top portion 21 and middle portion 22 of the primary frame 20. This provides for a more compact unit in the retracted, or collapsed, configuration and prevents interference between the backpack 11 and secondary support assembly 12 in movement between that position and the fully deployed position, or second attitude.

Removal of the support apparatus 10 by the person is accomplished by a reversal of the foregoing procedure. When the support apparatus has been removed, such as at a rest stop or campsite, the support apparatus can be adjusted to the second attitude shown in FIGS. 1, 3, 4 and 5. In the second attitude, the support apparatus can be employed to support the backpack in the upright fashion. In addition, the seat panel 130 can be employed as a surface of secondary support such as for use as a chair, table or the like. Usage of the seat panel as a chair is depicted in FIG. 5. When so used, the support apparatus 10 is placed on a surface of support 13, such as the ground, with the support surface 88 and lower rest surfaces 34 rested on the surface of support 13 as shown in FIGS. 3, 4 and 5. Adjustment of the support apparatus from the first, or collapsed, attitude shown in FIG. 2 to the second, or opened, attitude shown in FIGS. 1, 3, 4 and 5 is readily achieved.

In the first attitude, the seat panel is wrapped around primary frame 20, secondary frame 85 and tertiary frame 100, as shown in FIG. 2. In this first attitude, the seat panel remains attached to the tertiary frame 100 between the two proximal corners 135. However, the connectors 140 and 165 are released from each other on both sides of the secondary frame 85 to release the straps 138 and, thereby the seat panel 130. The tertiary frame is then folded forwardly against the secondary frame and the secondary frame folded upwardly against the top portion 21 of primary frame 20 so that the support apparatus is disposed in the first attitude shown in FIG. 2. The seat panel is then wrapped around the upper end portions of the primary, secondary and tertiary frames. The strap 110 is released from the connector 122 and the straps 110 and 120 wrapped about the seat panel and again interconnected using the connector 122 to secure: the support apparatus in this first attitude, as shown in FIG. 2.

Thus, in adjusting the secondary support assembly 12 to the second attitude shown in FIGS. 1, 3, 4 and 5, the process just described is reversed. In other words, the straps 110 and 120 are disconnected and the seat panel 130 is unwrapped from the primary, secondary and tertiary frames 20, 85 and 100 respectively. The secondary frame 85 is then rotated downwardly to the position shown in FIG. 1. The tertiary frame 100 is rotated upwardly to the position also shown in FIG. 1, but perhaps best shown in FIGS. 3, 4 and 5. In other words, as viewed therein, the tertiary frame is moved to a position substantially right-angularly related to the secondary frame.

Subsequently, the seat panel 130 is extended rearwardly from the tertiary frame 100 toward the primary frame 20. The straps 138 are extended over the brackets 150 and the pins 151 thereof individually inserted through corresponding holes in the straps to retain the seat panel in the attitude shown in FIG. 1. Connectors 165 and 140 are then individually interlocked so as to retain the straps 138 and 160 on each side of the secondary frame in the interconnected configurations shown in FIGS. 1, 3, 4 and 5. The end 112 of strap 110 is slidably inserted through connector 122 and pulled downwardly so that strap 110 and strap 120 are tautly interconnected. The end 112 of strap 110 can be pulled more tightly or loosened in connector 122 to adjust the tautness of strap 110 and strap 120 and thus of the seat panel 130. The end portions 142 of straps 138 can be pulled upwardly to tighten the tautness applied to straps 138 and 160, or slidably loosened to reduce the tautness so as to adjust the angle of the primary frame 20 of the backpack, as previously described.

The support apparatus 10 is then rested on a surface of support 13 in the upright attitude shown in FIGS. 3 and 4. Engagement of the support surfaces 34 and 88 with the surface of support 13 affords a very stable support for the support apparatus. As depicted in FIG. 4, even with the backpack 11 fully loaded, the center of gravity 170 of the support apparatus remains between reaction force 174 and reaction force 176 and this is true whether or not any weight is rested on the seat panel 130. Thus, the support apparatus operates as a packstand with the bag 40 of the backpack 11, and all of the compartments thereof, easily accessible for the removal or input of any items as desired. Adjustment of the tautness of the interconnected straps 138 and 160 can be employed to adjust the angle, or rake, of the primary frame 20 of the backpack so as, if desired, to move the center of gravity 170, or to make the compartments of the backpack more readily accessible.

Similarly, the seat panel 130 remains available for use as a surface of support as desired. Normally its usage is as a seat on which a person can sit, as depicted in FIG. 5. As shown therein, the posterior 185 of the person 180 engages the upper surface 132 of the seat panel and the weight of the person in this seated attitude is supported thereby. As also shown therein, the center of gravity 188 of the person is thus applied and remains between the reaction forces 174 and 176. Thus, both of the centers of gravity 170 and 188 are always between the reaction forces 174 and 176. Accordingly, the support apparatus virtually always remains securely stabilized in the upright attitude shown in FIGS. 3, 4 and 5 regardless of how it is employed as described. The end portion 112 of strap 110 can be adjusted as described to increase or decrease the tension on the seat panel for any purpose as desired, such as the comfort of the person seated thereon.

Alternatively, the upper surface 132 of the seat panel 130 can be employed to support other work objects and the tension of the seat panel can be adjusted as described as best suited to this alternative purpose. For example, the tension on the seat panel can be loosened so that the seat panel can support items such as food or medical supplies above the earth's surface so as to be in a more sanitary environment and more protected from insects and the like.

Once usage of the support apparatus 10 in the second attitude has been completed, it is again adjusted to the first, or collapsed, attitude in the manner heretofore described.

Therefore, the support apparatus of the present invention is adapted to support a work object while being operable to afford a secondary surface of support when desired; is uniquely well suited to the support of a backpack in an upright fashion; is operable to provide a surface of support for the weight of a human being or the like while supporting a backpack in an upright attitude whether or not the secondary surface of support is occupied; can conveniently be retracted to a position suitable for transport; is lightweight and easy to carry; and is otherwise entirely successful in achieving its operational objectives.

Although the invention has been herein shown and described in what is conceived to be the most practical and preferred embodiment, it is recognized that departures may be made therefrom within the scope of the invention which is not to be limited to the illustrative details disclosed.

Having described our invention, what we claim as new and desire to secure by Letters Patent is:

1. A support apparatus comprising:

A. a backpack having a primary frame with lower support portions disposed for rested engagement with a surface of support with the backpack disposed in upright relation;

B. a secondary frame mounted on the primary frame of the backpack for movement between a first attitude adjacent to said primary frame and a second attitude extending outwardly from the primary frame and having a surface disposed in said second attitude for rested engagement with a surface of support in spaced relation to the lower support portions of the primary frame so as to provide substantially stable support for the backpack in a substantially upright attitude;

C. a tertiary frame mounted on the secondary frame for movement between a first position, disposed in a substantially collapsed position adjacent to the secondary frame, and a second position extending outwardly from the secondary frame; and D. a flexible panel mounted on the tertiary frame and adapted to be extended over and supported on the secondary frame in said second attitude to deploy the flexible panel in a support position for the receipt of a second work object in rested relation thereon, the flexible panel having a pair of straps adapted to be secured on the secondary frame to retain the flexible panel in said support position, a strap assembly adapted to interconnect the tertiary frame and the secondary frame to apply tension to the flexible panel to retain said flexible panel in said support position and second strap assemblies individually adapted to be connected to each of the straps of the flexible panel and mounted on the primary frame to apply tension to the flexible panel to retain said flexible panel in said support position.

2. The support apparatus of claim 1 wherein at least one of said strap assemblies includes means for increasing, or alternatively decreasing, the tension on the flexible panel in said support position.

3. The support apparatus of claim 2 wherein at least one of the strap assemblies includes means for rapidly disconnecting said strap assembly.

4. The support apparatus of claim 3 wherein the flexible panel in said support position is dimensioned to support a person in seated relation thereon.

5. A support apparatus comprising:

A. a backpack having a primary frame with lower support portions disposed for rested engagement with a surface of support with the backpack disposed in upright relation;

B. a secondary frame mounted on the primary frame of the backpack for movement between a first attitude adjacent to said primary frame and a second attitude extending outwardly from the primary frame and having a surface disposed in said second attitude for rested engagement with a surface of support in spaced relation to the lower support portions of the primary frame so as to provide substantially stable support for the backpack in a substantially upright attitude;

C. a tertiary frame mounted on the secondary frame for movement between a first position, disposed in a substantially collapsed position adjacent to the secondary frame, and a second position, extending outwardly from the secondary frame;

D. a flexible panel mounted on the tertiary frame and, when the secondary frame is in the second attitude and the tertiary frame is in the second position, adapted to be extended from the tertiary frame across the secondary frame to deploy the flexible panel in said support position and wherein the flexible panel has a pair of straps adapted to be secured on the secondary frame to retain the flexible panel in said support position, strap assemblies individually adapted to be connected to each of the straps of the flexible panel and mounted on the primary frame to apply tension to the flexible panel to :retain it in said support position, at least one of said strap assemblies including means for increasing, or alternatively decreasing, tension on the flexible panel in said support position, at least one of the strap assemblies including means for rapidly disconnecting said strap assembly, the flexible panel in said support position is dimensioned to support a person in seated relation thereon and wherein the centers of gravity of the backpack and of a person seated on the flexible panel in said support position are between and above said lower support portions of the primary frame and said surface of the secondary frame to afford said substantially stable support; and E. another strap assembly adapted to interconnect the tertiary frame and the secondary frame to apply tension to the flexible panel to retain said flexible panel in said support position.

* * * * *

UNITED STATES PATENT AND TRADEMARK OFFICE

CERTIFICATE OF CORRECTION

PATENT NO. : 5,533,654

DATED : July 9, 1996

INVENTOR(S) : ANTON G. HOLTY; FREDERICK J. WILSON; EDWARD D. SOZINHO

It is certified that error appears in the above-identified patent and that said Letters Patent is hereby corrected as shown below:

Column 2, line 51, delete "carded" and substitute

---carried---;

Column 5, line 62, delete "corner's" and substitute

---corners---;

Column 6, line 5, delete "tings," and substitute

---rings,---;

Column 7, line 60, delete "secure:" and substitute

---secure---; and

Column 10, line 41, delete ":retain" and substitute

---retain---.

Signed and Sealed this

Twenty-fourth Day of September, 1996

*Attest:*

*Attesting Officer*

BRUCE LEHMAN

*Commissioner of Patents and Trademarks*